US005127870A

United States Patent [19]

Lin

[11] Patent Number: 5,127,870

[45] Date of Patent: Jul. 7, 1992

[54] ECHO-TYPE TOY MEGAPHONE

[75] Inventor: Ho Y. Lin, Taichung Hsien, Taiwan

[73] Assignee: You Hsing Plastics Co, Ltd., Taichung Hsien, Taiwan

[21] Appl. No.: 730,689

[22] Filed: Jul. 16, 1991

[51] Int. Cl.[5] ..... A63H 5/00; G08B 1/00

[52] U.S. Cl. ..... 446/416; 181/138

[58] Field of Search ..... 446/397, 416, 415, 417, 446/408, 409, 484, 486; 181/138, 242, 157, 141

[56] References Cited

U.S. PATENT DOCUMENTS

| | | | |
|---|---|---|---|
| 453,600 | 6/1891 | Sunderland | 181/138 |
| 481,133 | 8/1892 | Bowen | 181/138 |
| 1,259,600 | 3/1918 | Carlisle | 446/416 X |
| 1,576,903 | 3/1926 | Fontanella | 446/416 |
| 2,201,588 | 5/1940 | Kuhns | 446/485 X |
| 2,623,957 | 12/1952 | Cragg et al. | 181/242 |
| 2,806,906 | 9/1957 | Junghans | 181/242 X |
| 3,343,298 | 9/1967 | Green | 446/416 |
| 4,187,635 | 2/1980 | Deissler | 446/416 |

FOREIGN PATENT DOCUMENTS

| | | | |
|---|---|---|---|
| 235083 | 6/1925 | United Kingdom | 446/416 |

*Primary Examiner*—Mickey Yu
*Assistant Examiner*—D. Neal Muir
*Attorney, Agent, or Firm*—Poms, Smith, Lande & Rose

[57] ABSTRACT

A toy megaphone including a housing having a number of openings formed in the upper end, a member fixed in an upper portion of the housing, and a spring biased between the member and a lower end of the housing, and the member and the spring being caused to vibrate when a sound wave is propagated into the housing via the openings.

1 Claim, 3 Drawing Sheets

ECHO-TYPE TOY MEGAPHONE

BACKGROUND OF THE INVENTION

1. Field of the Invention

The present invention relates to a toy megaphone, and more particularly to an echo type toy megaphone.

2. Description of the Prior Art

Typical toy megaphone or toy microphone includes only a housing which has a shape similar to a microphone such that children may simulate singing a song with a microphone.

The present invention has arisen to provide a novel toy megaphone.

SUMMARY OF THE INVENTION

The primary objective of the present invention is to provide a toy megaphone which generates an echo type sound in response to the user's voice or the like.

In accordance with one aspect of the invention, there is provided a toy megaphone including a housing having a number of openings formed in an upper end thereof, a member fixed in an upper portion of the housing, and a spring biased between the member and a lower end of the housing, and the member and the spring being caused to vibrate when a sound wave is propagated into the housing via the openings.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
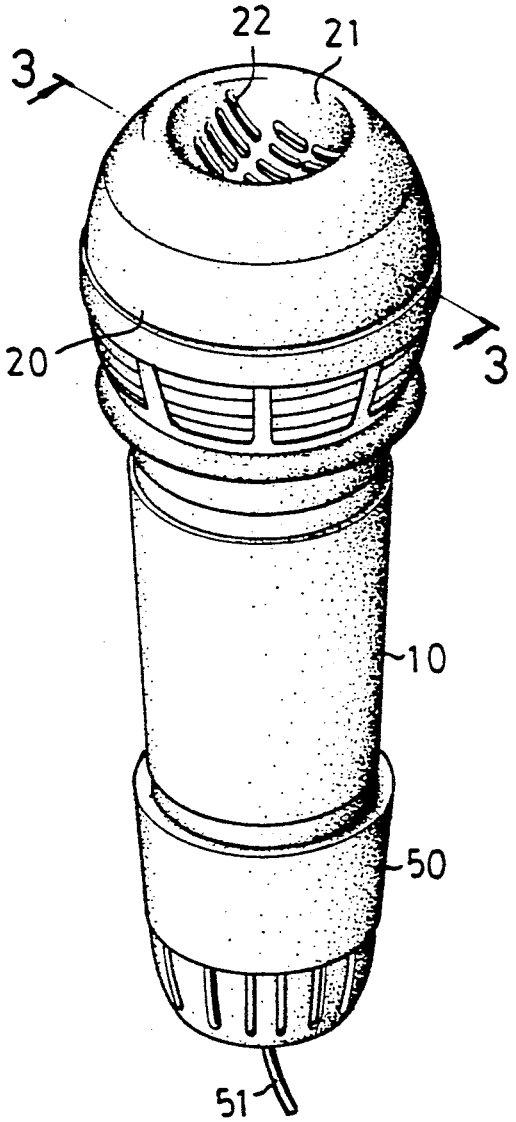
FIG. 1 is a perspective view of an echo type toy megaphone in accordance with the present invention.
Figure 2:
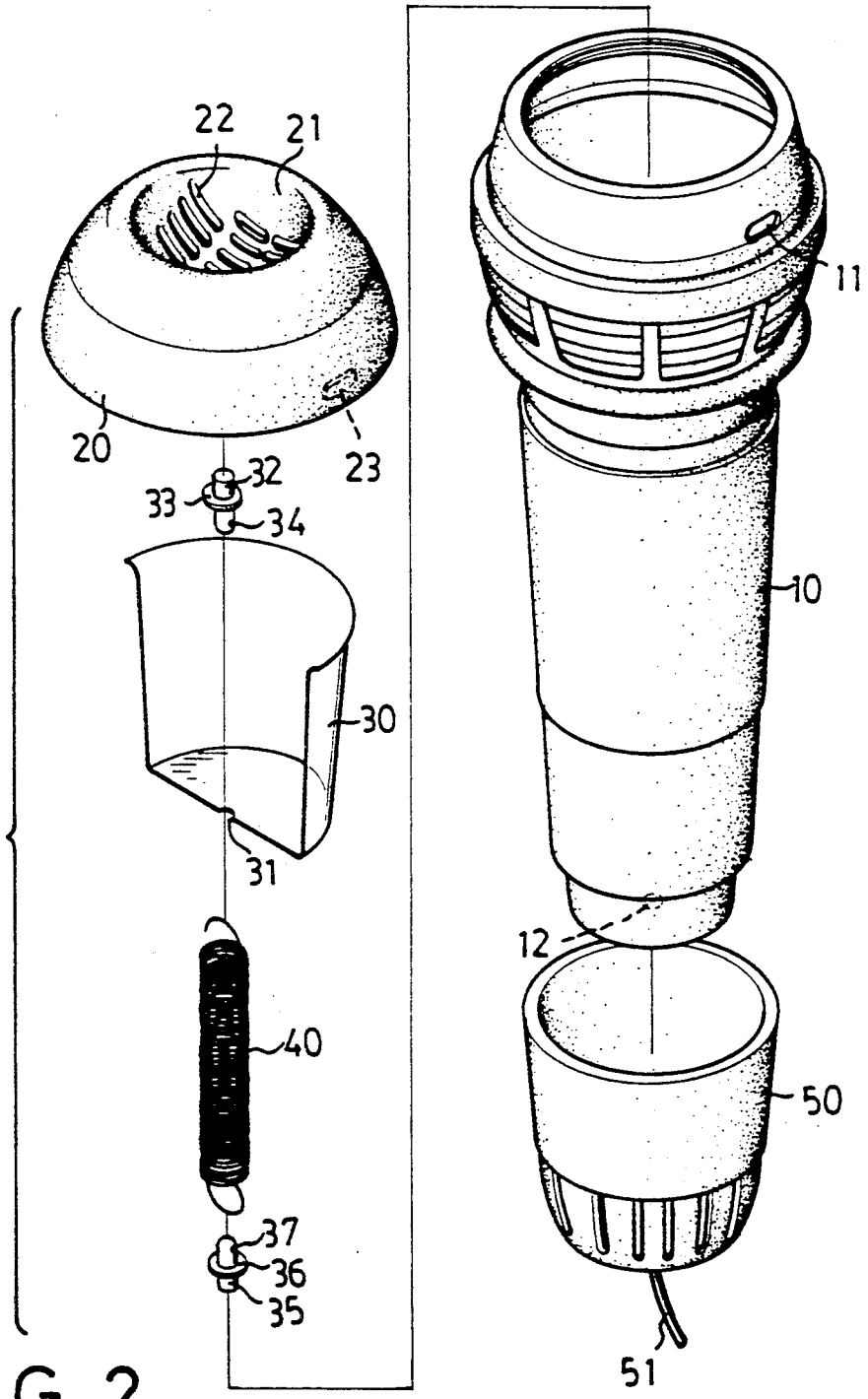
FIG. 2 is an exploded view of the echo type toy megaphone.

Referring to the drawings and initially to FIGS. 1 and 2, a toy megaphone in accordance with the present invention has a shape similar to a microphone or a megaphone and comprises generally a housing 10 having a cap 20 disposed on the top thereof. A pair of dents 11 are formed oppositely in the upper portion of the housing 10. The cap 20 has a recess 21 formed in the top thereof and has a plurality of openings 22 formed in the recess 21. A pair of bulges 23 are oppositely formed on the lower portion of the cap 20 and are engageable with the dents 11 of the housing 10 respectively so that the cap 20 can be engaged on the housing 10. Alternatively, the cap 20 can be fixed to the housing 10 by such as adhesive materials.

Figure 3:
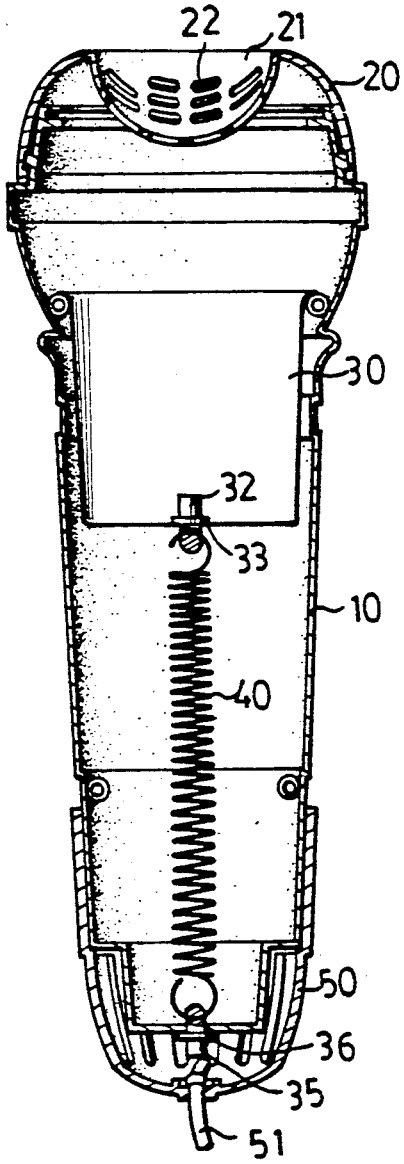
FIG. 3 is a cross sectional view of the echo type toy megaphone, taken along lines 3—3 of FIG. 1.

Referring next to FIG. 3 and again to FIG. 2, a member 30 which is cup shaped has an upper peripheral surface fixed to the inner surface of the upper portion of the housing 10 by such as adhesive materials. The member 30 is preferably made of plastic materials and is preferably made as thin as possible. An aperture 31 is formed in the bottom of the member 30. A pin 32 which has a disc 33 fixed thereon extends through the aperture 31 of the member 30 and has a hole 34 formed in the bottom thereof. A pin 35 which has a disc 36 fixed thereon extends through an orifice 12 formed in the bottom of the housing 10 and has a hole 37 formed in the top thereof. A spring 40 has the end portions hooked through the holes 34, 37 of the pins 32, 35 and is suitably tensioned so that the pins 32, 35 can be stably retained in place. A lid 50 is further fixed to the bottom of the housing 10 for covering the pin 35. A dummy wire 51 is fixed to the lid 50 for simulating a radio microphone.

In operation, when a user has his mouth directed toward the cap 20 and makes a sound, for example, speaking or singing a song, the member 30 and the spring 40 will be caused to vibrate by the sound wave of the sound made by the user, so that a resonance and an echo will be generated. The housing 10 and the member 30 act as a resonance box.

Accordingly, the toy megaphone in accordance with the present invention generates an echo type sound as the user speaking or singing a song.

Alternatively, when the user shakes the toy megaphone in accordance with the present invention, the spring will also be caused to vibrate so that an echo will be generated.

Alternatively, the member 30 can be a flat membrane type object, and the spring 40 is coupled between the member 30 and the lower end of the housing 10. The spring 40 can also be caused to vibrate when the housing is shaken.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toy megaphone comprising a housing including a cap fixed on an upper end thereof, said cap having a plurality of openings; a substantially cup-shaped member disposed within said housing and having an upper peripheral surface fixed to an upper portion of said housing; a coupler engaged on a bottom of said member and on a lower internal end of said housing respectively; a spring including two ends engaged with said couplers so that said spring is coupled between said member and said lower end of said housing; and a lid fixed to said lower end of said housing for covering said coupler disposed on said lower end of said housing; whereby said member and said spring are caused to vibrate when a sound wave is propagated into said housing via said openings.

* * * * *